United States Patent [19]

Fairbrother et al.

[11] Patent Number: 4,473,107

[45] Date of Patent: Sep. 25, 1984

[54] FAN/COIL INDUCTION UNIT, SYSTEM, AND METHOD

[75] Inventors: Larry E. Fairbrother; Jack H. DeMaat, both of Grand Rapids, Mich.

[73] Assignee: Building Facilities Corporation, Ada, Mich.

[21] Appl. No.: 294,376

[22] Filed: Aug. 19, 1981

[51] Int. Cl.[3] ..... F24F 3/00

[52] U.S. Cl. ..... 165/2; 165/16; 165/22; 165/48 R; 165/54; 98/33 A; 98/38 E; 98/38 F

[58] Field of Search ..... 165/48, 50, 53, 2, 59, 165/22, 16, 54; 236/49; 98/40 DL, 33 A, 38 E, 38 F; 62/179

[56] References Cited

U.S. PATENT DOCUMENTS

| | | | |
|---|---|---|---|
| 3,179,162 | 4/1965 | McFarlan | 165/22 |
| 3,720,258 | 3/1973 | Chandler | 236/49 |
| 3,842,901 | 10/1974 | McFarlan | 165/22 |
| 3,853,172 | 12/1974 | McFarlan | 165/22 |
| 3,929,285 | 12/1975 | Daugherty, Jr. | 236/49 |
| 4,034,801 | 7/1977 | Bernstein | 165/48 |
| 4,061,186 | 12/1977 | Ljung | 165/59 |
| 4,157,112 | 6/1979 | Swiderski | 165/50 |
| 4,300,623 | 11/1981 | Meckler | 165/50 |

OTHER PUBLICATIONS

Roger W. Haines, *Control Systems for Heating, Ventilating and Air Conditioning,* 2nd ed., ©1977, pp. 126–129 and pp. 135–138.

"McQuay Thinline II Seasonmaker" Catalog 716–2 published by McQuay, Inc., Minneapolis, Minnesota (©1969).

"Thinline II McQuay Seasonmaker" Catalog 717–4 published by McQuay–Perfex Inc., Minneapolis, Minnesota (©1978).

"Thinline Seasonmaker" Catalog 718–3 published by McQuay–Perfex Inc., Minneapolis, Minnesota (©1980).

"McQuay Seasonmaker" Catalog 722–6 published by McQuay–Perfex Inc., Minneapolis, Minnesota (©1968).

"McQuay Large Capacity Seasonmaker Fan–Coil Units" Catalog 730–5 published by McQuay–Perfex Inc., Minneapolis, Minnesota (©1975).

"Terminal Reheat Induction Air Conditioning" Catalog DS–IUNT2–20–774–RWS–RFS–P/S, published by the Trane Company, LaCrosse, Wisconsin (©1974).

"Induction Unitrane" Catalogue DS IUNT–1–974–47–9–LPC published by the Trane Company, LaCrosse, Wisconsin (©1979).

*Primary Examiner*—Albert W. Davis, Jr.

*Attorney, Agent, or Firm*—Price, Heneveld, Huizenga & Cooper

[57] ABSTRACT

A system for heating, cooling, and ventilating a structure having exterior zones adjacent exterior walls and interior zones adjacent the exterior zones and opposite the exterior walls. The system includes for each pair of exterior and interior zones a first terminal unit for moving air from the interior zone to the exterior zone and a second terminal unit for moving air from the exterior zone to the interior zone. The first unit includes structure for selectively heating and cooling the air moved. The second unit includes structure for selectively cooling the air moved. The terminal units further include a casing defining an inlet and an outlet, fan structure for moving recirculation air through the casing from the inlet to the outlet, and structure for introducing primary air into the casing upstream of the fan structure so that primary air is induced into the recirculation air. Also disclosed is a method of heating, cooling, and ventilating a structure using the system disclosed.

23 Claims, 5 Drawing Figures

FAN/COIL INDUCTION UNIT, SYSTEM, AND METHOD

BACKGROUND OF THE INVENTION

The present invention relates to heating, ventilating, and air-conditioning (HVAC) equipment, systems, and methods.

Perhaps the most widely accepted HVAC system on the market today is the variable air volume (VAV) system. This system utilizes a large central air-handling unit and large ducts to deliver heated or cooled primary air to remote terminal boxes or zones. These boxes are thermostatically controlled to provide the volume of air required to maintain the zone at a desired temperature, or within a desired temperature range. Perimeter spaces (i.e., those spaces proximate exterior walls) have some form of radiation or secondary heating and cooling systems to compensate for thermal transmission through the exterior walls.

VAV systems are generally energy efficient, have a reasonable first cost, and are relatively easy to maintain and operate. However, these systems also have their disadvantages. First, VAV systems have a relatively high operating cost. Because all cooling requirements are met by a central air handling unit, relatively large fans and ductwork are required to move the large volume of air required. These large fans are relatively expensive to operate, and the large ducts are relatively expensive to construct and require a great deal of building volume. Further, VAV systems have many months when both heating and cooling equipment must be operated simultaneously to properly regulate the temperature of all zones within the structure. Obviously, this is a wasteful use of energy.

As is well-known to those skilled in the art, the interior area of a structure remote from the exterior walls contains an excess of heat generated, for example, by people, lights, and equipment. Consequently, these interior spaces must be cooled during much of the heating season, as well as during the cooling season. VAV systems typically blow this excess heat out of the building rather than making an attempt to reclaim the heat.

Further, VAV systems are extremely difficult to apply without violating regulations promulgated by government. Typically, VAV systems require daily adjustment of both equipment and thermostats to meet, in particular, the Emergency Temperature Regulations.

Additionally, air is throttled by VAV systems to properly regulate the temperature of the separate zones. This throttling of air flow can result in inadequate ventilation and also a "dead air" feeling.

Finally, VAV systems require many man hours to test and balance. Generally speaking, any one portion of the system is not balanced until all of the other portions are balanced.

Typically, VAV perimeter heating is supplied using fin tubing which provides convection heating. Other secondary heating and cooling systems used in conjunction with VAV systems include fan/coil units and induction units. Fan/coil units include a casing, a fan for moving air through the casing, and heating and/or cooling coils to warm or cool the air moving through the unit, as necessary. However, these units merely recirculate existing room air and do not provide for introducing outside air into the building at the unit.

On the other hand, induction units include a casing, structure for jetting primary air out of the casing thereby inducing room air to circulate through the casing, and heating and/or cooling coils to warm or cool the air moving through the unit, as necessary. Although induction units provide for the introduction of primary air, this is accomplished through relatively high pressure primary air supply systems, which are both complex and expensive.

SUMMARY OF THE INVENTION

The aforementioned problems are solved by the present invention. Essentially, a HVAC system, denominated a fan/coil induction system, is provided for a building having an exterior zone adjacent an exterior wall and an interior zone adjacent the exterior zone and opposite the exterior wall. The system includes a first structure for moving air from the interior zone to the exterior zone, a second structure for moving air from the exterior zone to the interior zone, and a structure operatively connected to at least one of the air-moving structures for introducing primary, or outside, air into the building. Additionally, apparatus is included on the first air-moving structure for selectively heating and/or cooling the air moved from the interior zone to the exterior zone. Somewhat similarly, apparatus is included on the second air-moving structure for selectively cooling air moved from the exterior zone to the interior zone. In a preferred embodiment, the air-moving structure has a fixed output volume while the building is occupied so that constant ventilation is provided.

The air-moving structure includes satellite terminal units which also are novel. Essentially, a terminal unit is provided having a casing defining an inlet and an outlet, fan structure for moving recirculation air through the casing from the inlet to the outlet, structure positioned upstream of the fan structure for introducing primary air into the recirculation air moving through the casing, and structure for cooling at least a portion of the air moving through the casing. Accordingly, primary air is induced into the recirculation air moving through the terminal units when the fan structure is operating.

Finally, a method of heating, cooling, and ventilating a structure in accordance with the present invention includes the steps of moving air from an interior zone of the building to an exterior zone, selectively heating and/or cooling this air, moving air from the exterior zone to the interior zone, selectively cooling that air, and introducing primary air into at least some of the moving air to supply primary air to the building.

The system, terminal unit, and method of the present invention have significant advantages over their prior art counterparts. First, the present system is more efficient, resulting in lower operating costs. During the heating season, the present system uses the excess heat generated in the interior zone of the building by people, lights, and equipment to warm the exterior zone, whereas prior art systems typically blow this excess heat out of the building. Further, the individual fans on the terminal units use less energy collectively than would be required by a single fan in a VAV system moving a comparable volume of air. Accordingly, the reduced fan energy consumption results in savings on electric bills.

The present system does not permit simultaneous heating and cooling to occur within the building so that energy is not simultaneously consumed to produce both heating and cooling effectively working against each other to provide the desired temperatures. Because terminal units are used to recirculate air between zones, smaller ductwork may be used than in VAV systems which must supply air to all zones through a single central air handling unit. Consequently, this smaller ductwork is easier and faster to install and does not require as much building volume as does a comparable VAV system. Further, the unit supplying primary air to the system is significantly smaller and easier to service than its VAV counterparts because much of the heating and cooling is performed at the terminal units.

Further, the present system inherently complies automatically with all governmental regulations, particularily E.T.R.A. 65-78. Although this regulation is currently suspended, the threat of its revival compels building design complying with its provisions. No daily adjustments are required to insure compliance with the standards. VAV systems are simply not adaptable to all applicable regulations without constant year-round daily adjustment of both equipment and thermostats.

A further advantage of the present invention is that a constant volume of air circulation is provided regardless of building heating and cooling requirements. The volume of air is not throttled to control temperature as in VAV systems.

Finally, air balancing of the present system and method is greatly facilitated because each zone may be balanced individually and separately from all other zones. The relatively small ducts serving the terminal units require fewer balancing adjustments than comparable VAV systems.

These and other objects, advantages, and features of the invention will be more fully understood and appreciated by reference to the written specification and appended drawings.

DESCRIPTION OF THE PREFERRED EMBODIMENT

Figure 1:
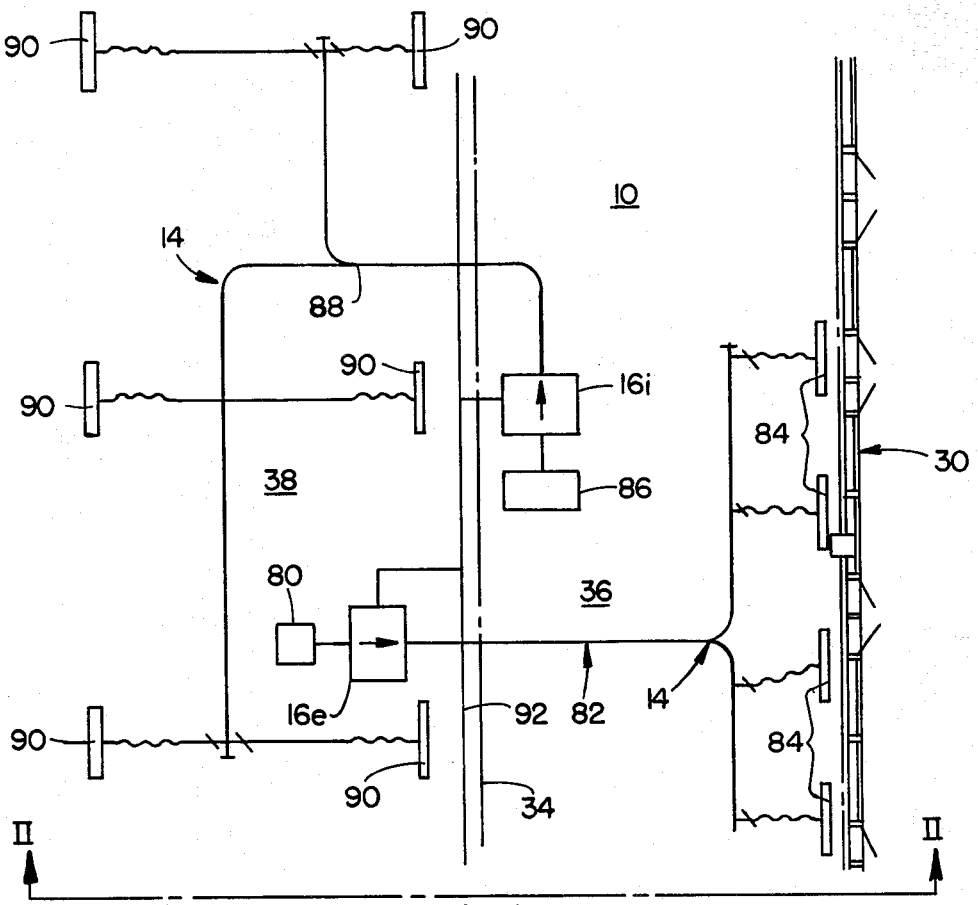
FIG. 1 is a partial top plan view of the air circulation portion of an HVAC system constructed in accordance with the present invention with the hot water and chilled water piping omitted.
Figure 2:
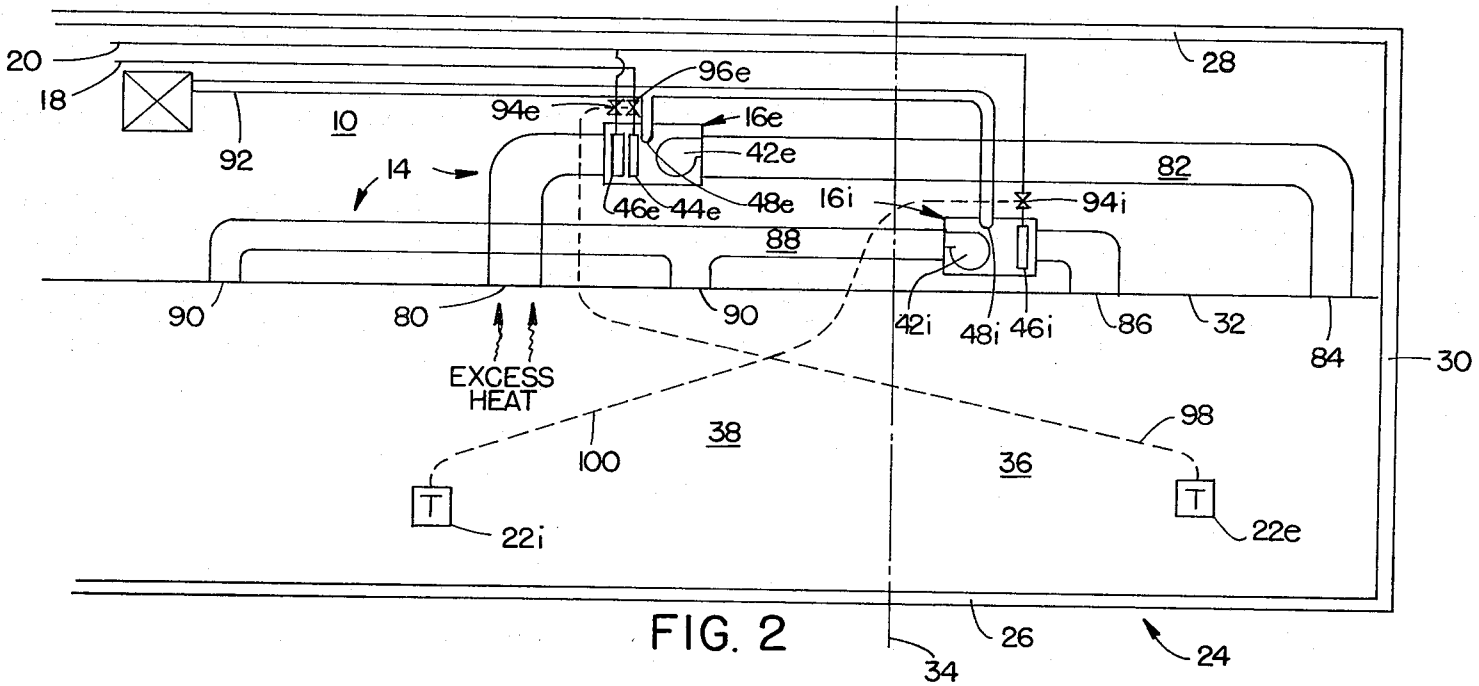
FIG. 2 is a side elevational view taken along plane II—II in FIG. 1, showing the exterior FCI unit elevated above the interior FCI unit for clarity and including the hot water and chilled water piping.
Figure 3:
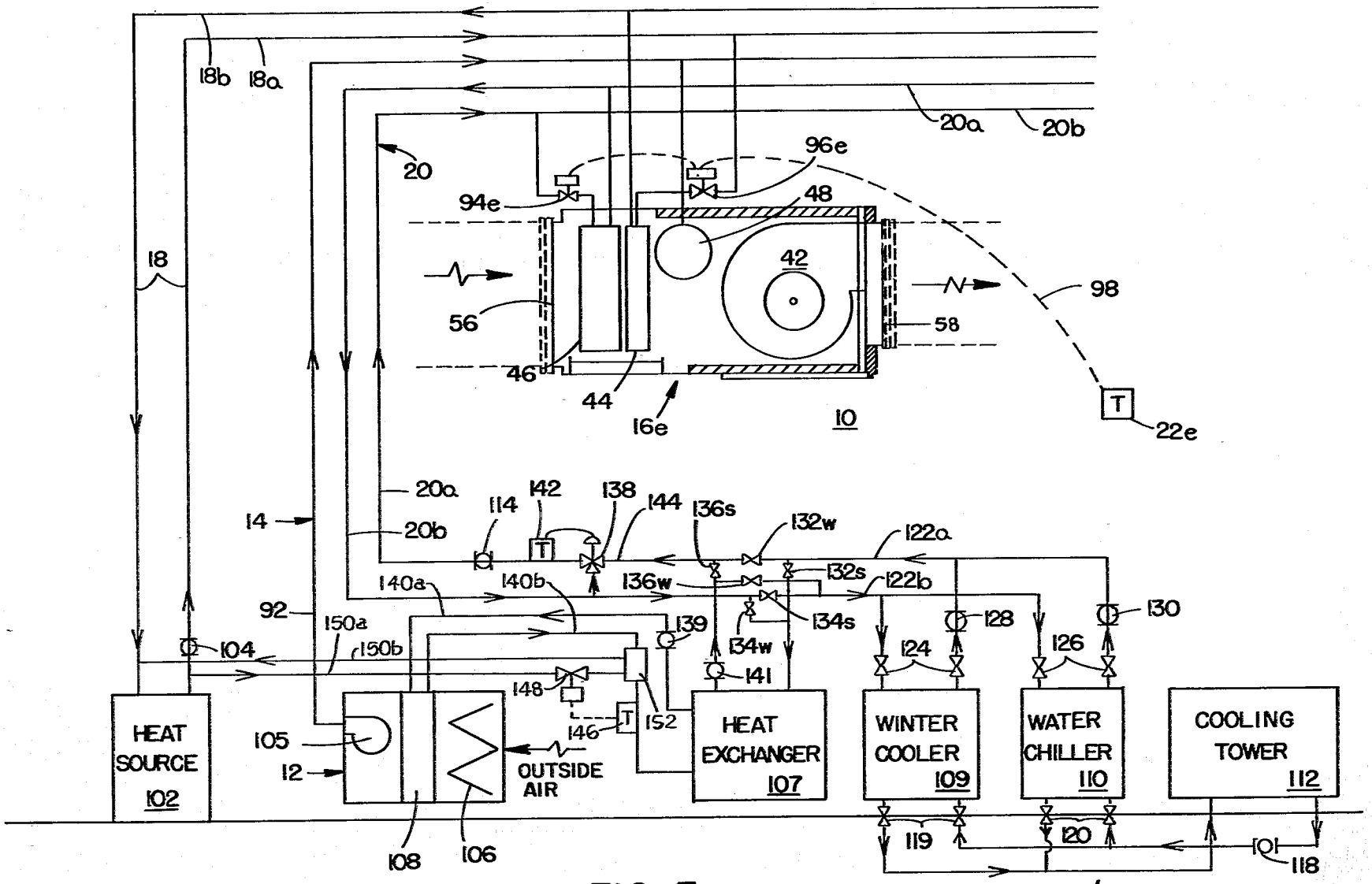
FIG. 3 is a schematic diagram of the hot water, chilled water, and primary air supply of the HVAC system.

An HVAC system in accordance with a preferred embodiment of the invention is illustrated in the drawings and generally designated 10. As seen in FIGS. 1, 2, and 3, system 10 includes a central air-handling unit 12, a duct system 14, terminal units 16, heating piping 18, cooling piping 20, and thermostats 22. In FIGS. 1 and 2, system 10 is shown installed within one floor, or story, of a portion of building 24. Very generally, building 24 includes a floor 26, a ceiling 28, an exterior wall 30, and false ceiling 32. The interior of building 24 is separated by imaginary line 34 into exterior zone 36 adjacent exterior wall 30 and interior zone 38 adjacent exterior zone 36 and opposite wall 30. The distance between wall 30 and line 34 will vary greatly from building to building depending on thermal characteristics.

As is well-known, a great deal of excess heat is generated in interior zone 38 by people, lights, and equipment. However, during the heating season, exterior zone 36 requires heating, as it is adjacent exterior wall 30 and loses heat through the wall. The present invention takes advantage of the excess heat produced in interior zone 38 to warm exterior zone 36 during the heating season. Terminal unit **16*e* moves this relatively warm air from interior zone 38 to exterior zone 36, moving the excess heat generated in the interior zone to the exterior zone. Similarly, interior terminal unit 16*i* moves relatively cool air from exterior zone 36 to interior zone 38, thereby cooling the interior zone with relatively cool air from the exterior zone. Only enough primary air from central unit 12 is introduced at terminal units 16** to meet the building ventilation and dehumidification needs.

Figure 5:
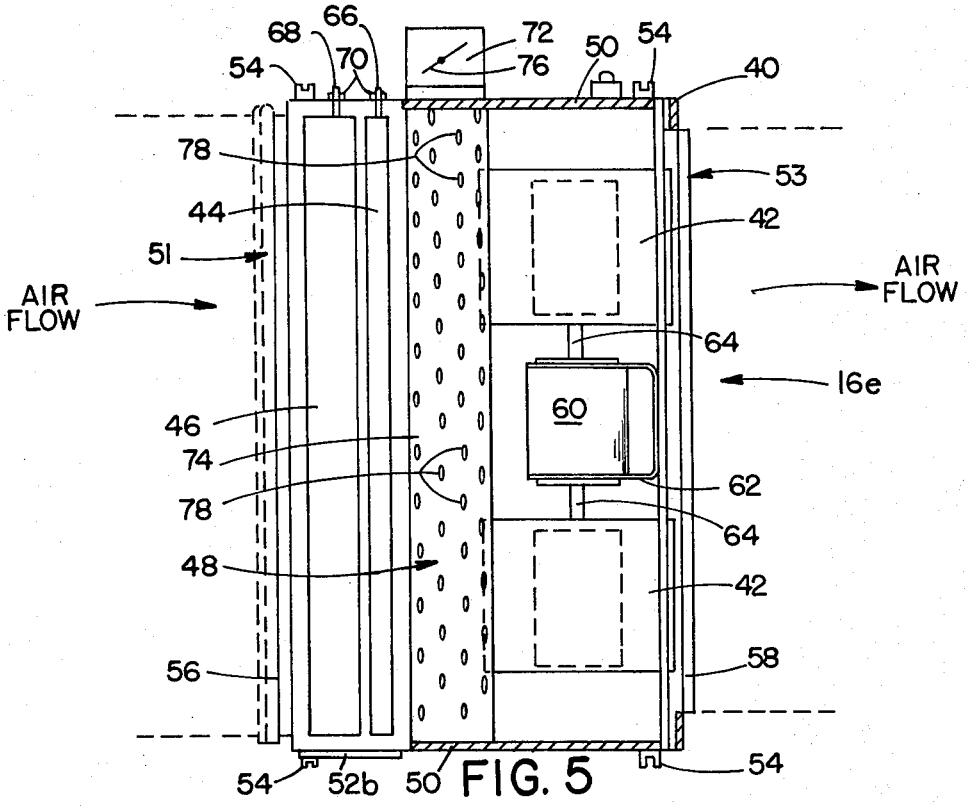
FIG. 5 is a top sectional view of the exterior terminal unit.
Figure 4:
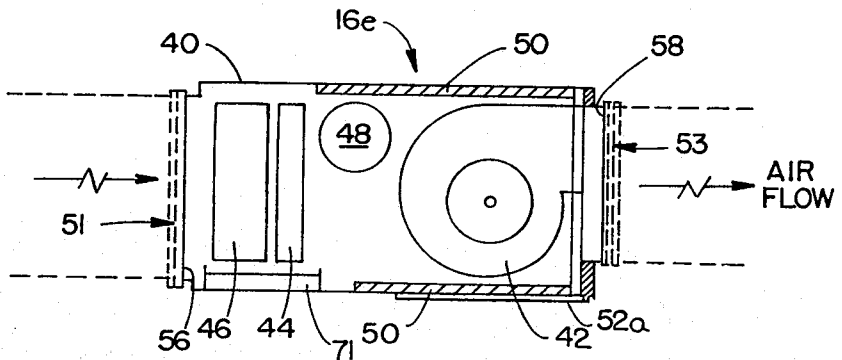
FIG. 4 is a side sectional view of an exterior terminal unit constructed in accordance with the present invention.

A terminal fan/coil induction (FCI) unit is accordance with the present invention is shown in the drawings and generally designated 16. More particularly, those terminal units serving exterior zone 36 (i.e., moving air to the exterior zone) are denominated **16*e*, while units serving interior zone 38 (i.e., moving air to the interior zone) are denominated 16*i*. As seen in FIGS. 4 and 5, exterior FCI unit 16*e* comprises casing 40, fan 42, hot water coil 44, chilled water coil 46, and primary air inlet 48. When the building is occupied, fans 42 operate at a fixed rate of speed to provide a constant volume of circulation to exterior zone 36. As air is drawn through unit 16*e* by fans 42, the room air to be recirculated is drawn through cooling coil 46 and hot water coil 44. By selectively actuating cooling coil 46 and hot water coil 44, the air recirculated by unit 16*e* may be selectively heated and cooled. Additionally, primary air from central unit 12 is induced into the recirculation airstream through primary air inlet 48**.

Interior FCI units **16*i* differ from exterior units 16*e* only in that interior units 16*i* do not include a hot water coil because interior zone 38** typically does not required heating.

The system and method of the present invention utilize the excess heat generated in interior zone 38 to partially heat exterior zone 36. Likewise, the relatively cool air in exterior zone 36 is moved to the interior zone 38 to provide "free cooling." Air moved to exterior zone 36 is selectively heated or cooled, as necessary, to regulate the temperature of the exterior zone, and air moved to interior zone 38 is selectively cooled, as necessary, to regulate the temperature of the interior zone. Only enough primary air is introduced into the system to satisfy the ventilation and dehumidification needs of building 24.

Fan/Coil Induction Unit

Turning more specifically to external FCI unit **16*e*, casing 40 is constructed of galvanized steel and internally lined with acoustical glass fiber insulation 50. Recirculation air inlet and outlet 51 and 53 are defined in opposite ends of casing 40. Access panels 52*a* and *b*** are provided for easy access to all internal components. Panels are gasketed and screwed in place using techniques well-known to those skilled in the art.

Mounting clips 54 are provided at the four upper corners of casing 40 so that the unit may be suspended from ceiling 28 using conventional hanger rods. Additionally, inlet duct connections 56 and outlet duct connections 58 are mounted about inlet and outlet 51 and 53, respectively, so that low pressure duct system 14 can be connected to unit 16*e* in a conventional manner.

Mounted within casing 40 substantially adjacent outlet 53 is fan 42, which is a furnace-type fan. Motor 60 is mounted through mounting bracket 62 to casing 40 and drives fan 42 through drive shaft 64. Consequently, when motor 60 is actuated, fan 42 draws air through casing 40 from inlet 51 to outlet 53. Motor 60 is a two-speed motor so that a higher volume of air flow is provided in summer and a lower volume in winter. This insures that the unit is capable of handling the air required to cool the building in the summer, while allowing a reduced fan setting in winter to conserve energy.

Hot water coil 44 and chilled water coil 46 are mounted within casing 40 upstream of fan 42 to be generally perpendicular to the flow of air therethrough. Air moving through unit 16*e* can be selectively heated and cooled by introducing hot water and chilled water into coils 44 and 46, respectively. Hot water coil connection 66 extends through casing 40, and, likewise, chilled water connection 68 similarly extends through casing 40. Both connections 66 and 68 are grommeted using grommets 70 to insure a proper seal within casing 40.

Drain pan 71 is positioned under cooling coil 46 to collect any moisture collecting on the coil. Moisture collects on coil 46 only during prolonged cool down periods. Any moisture collecting in pan 71 will evaporate from the pan after the cool down period is complete. The primary air supplied by primary unit 12 meets all building dehumidification needs so that little if any moisture collects on cooling coil 46. Therefore, pan 71 does not have to be connected to a drain pipe to empty the pan, except in extremely high humidity applications.

Primary air inlet 48 includes primary air duct connection 72 extending externally from casing 40 and dispersion tube 74 extending into the casing. A manual balancing damper 76 is mounted within duct connection 72 so that the volume of primary air flowing into casing 40 may be regulated. Dispersion tube 74 is a generally cylindrical member having a plurality of generally circular apertures 78 along its entire length. Apertures 78 are regularly spaced over the entire surface of tube 74 and preferably cover approximately 50% of the surface. Dispersion tube 74 facilitates induction of primary air into FCI unit 16*e*. Primary air inlet 48 is located upstream of fan 42 and downstream of coils 44 and 46. Consequently, as room air flows through the unit from inlet 51 to outlet 53, primary air is induced out of dispersion tube 74 by the moving airstream. Primary air delivered through inlet 48 need not be under pressure in order to insure that the primary air enters the recirculation airstream.

In a preferred embodiment of the invention, FCI unit 16*e* moves approximately 1.5 CFM per building square foot during the cooling season with motor 60 at its high speed setting, and approximately 1.0 CFM per building square foot during the heating season with fan 60 at its lower setting. Also in a preferred embodiment of the invention, damper 76 is adjusted so that the primary air supplied through inlet 48 accounts for approximately 10% of the air volume flowing through unit 16*e*. This means that approximately 0.15 CFM per building square foot of primary air is supplied during the cooling season, while approximately 0.1 CFM per building square foot of primary air is supplied during the heating season.

Interior FCI unit 16*i* is generally identical to exterior FCI unit 16*e* except that interior unit 16*i* of the preferred embodiment does not include a hot water coil. However, a hot water coil might be necessary in particular applications, most notably where ceiling 28 over interior zone 38 is not adequately insulated.

Fan/Coil Induction System

FCI units 16 of the present invention are shown installed within a building 24 (FIGS. 1 and 2). Generally, exterior unit 16*e* draws air containing excess heat through ceiling return air grill 80 and moves this air through duct 82 to diffusers 84 proximate exterior wall 30. Conversely, interior unit 16*i* draws air from exterior zone 36 through return air grill 86 and moves this air through duct 88 to diffusers 90 positioned in interior zone 38. Accordingly, air from interior zone 38 is used to warm exterior zone 36, while air from exterior zone 36 is used to cool interior zone 38.

Primary air is supplied through duct 92 to all of units 16. Hot water is supplied through hot water piping 18 to exterior unit 16*e*, while chilled water is provided through chilled water piping 20 to both interior and exterior units 16*i* and 16*e*. Hot water piping 18 is connected to exterior unit 16*e* at hot water connection 66, while chilled water piping 20 is connected to each FCI unit 16 at chilled water connections 68. Additionally, chilled water valves 94*e* and 94*i* (FIGS. 2 and 3) are inserted in piping 20 to control the flow of chilled water to coils 46*e* and 46*i*, respectively. Similarly, hot water valve 96*e* is inserted in piping 18 to control the flow of hot water to coil 44*e*. Valves 94*e* and 96*e* are connected to exterior zone thermostat 22*e* through line 98; valve 94*i* is connected to interior zone thermostat 22*i* through line 100.

In operation, during occupied hours, fans 42*e* and 42*i* operate continuously to provide a fixed volume of air flow from interior zone 38 to exterior zone 36 through unit 16*e* and a fixed volume of flow between exterior zone 36 and interior zone 38 through unit 16*i*. Often during the heating season, the interior zone air moved to the exterior zone is adequate to maintain the temperature in that zone at a desired level. Likewise, the cool air moved from the exterior zone to the interior zone is often adequate to cool the interior zone.

In a preferred embodiment of the invention, the temperature in both zones is allowed to float between 65° and 78° Fahrenheit before any mechanical heating or cooling is introduced. Accordingly, if the temperature at exterior zone thermostat 22*e* is between 65° and 78°, both of valves 94*e* and 96*e* are closed so that the air circulating through unit 16*e* is neither warmed nor cooled. However, if the temperature at thermostat 22*e* drops below 65°, valve 96*e* is opened, allowing hot water to flow through piping 18 into hot water coil 44*e*. Consequently, air moving through unit 16*e* will be warmed as it passes through the coil 44*e* to heat exterior zone 36. When the temperature rises to 65°, thermostat 22*e* closes valve 96*e*, so that the moving air is no longer warmed. Similarly, if the temperature at thermostat 22*e* rises above 78°, valve 94*e* is opened, allowing chilled water to flow from piping 20 into cooling coil 46*e*. Accordingly, the air flowing through 16*e* will be chilled as if flows through coil 46*e* and the air in exterior zone 36 will be cooled. Again, when the temperature passes into the desired range of 65° to 78°, valve 94*e* is closed, allowing air to circulate through unit 16*e* without being either heated or cooled.

The operation of unit 16*i* is somewhat similar to that above described for exterior unit 16*e*. The major difference being that interior unit 16*i* of the preferred embodiment does not include a heating coil because interior zone 38 typically does not require heating. Consequently, interior zone thermostat 22*i* closes valve 94*i* as long as the temperature in interior zone 38 is below 78°. However, when the temperature in interior zone 38 rises above 78°, thermostat 22*i* opens valve 94*i*, allowing chilled water to flow through piping 20 into cooling coil 46*i*. Consequently, air flowing through unit 16*i* is chilled and the temperature in interior zone 38 is lowered. When the temperature in interior zone 38 again falls below 78°, thermostat 22*i* closes valve 94*i* so that air passing through unit 16*i* is no longer cooled.

The temperatures described above in conjunction with the operation of the system of the present invention are arbitrary and have been selected for a particular application. The operation of the system does not depend on these temperature, and any temperatures may be selected as the critical temperatures at thermostats 22. The range of temperatures at which neither heating nor cooling is to be provided to the system may be made as narrow or wide as desired in a particular application.

The system of the present invention provides year-round temperature control by redistributing air from interior zone 38 to exterior zone 36, and vice versa, selectively heating and cooling the air, as necessary, to maintain desired zone temperatures. Full use is made of internal heat gains during the heating season by moving this warm air to the exterior wall where heating is required. Primary air is introduced into the building only to meet ventilation and dehumidification needs.

Hot Water, Chilled Water, and Primary Air Supply

The remainder of system 10 supplying hot water, chilled water, and primary air to FCI units 16 is shown in FIG. 3. Heat source 102 may be any type of conventional hot water source supplying hot water to piping 18. In a preferred embodiment of the invention, heat source 102 is a steam to hot water exchange unit. Hot water is forced by pump 104 through hot water supply line 18*a* and returned to heat source 102 through hot water return line 18*b*. Supply line 18*a* is connected through valve 96*e* to hot water coil 44, and return line 18*b* is also connected to hot water coil 44. The hot water supplied by heat source 102 is reset hot water temperature, which means that the temperature of the water generally varies inversely with the outside temperature. That is to say, for example, if it is 0° outside, the hot water temperature is 150°; but if the outside temperature is 50°, the hot water temperature is only 80°. By supplying reset hot water, unnecessary energy is not lost through piping 18 as the water is conveyed to and from heat source 102. Heat source 102 is actuated only during the heating season, as necessary, to meet the demands of exterior zone 36.

Primary air is supplied to building 24 by central air-handling unit 12. Central unit 12 includes a fan 105 which draws air through filters 106 and coil 108 and on into primary air supply duct 92. As will be described, coil 108 cools the primary air during the cooling season and preheats the primary air during the heating season. In a preferred embodiment of the invention, primary air is warmed to approximately 40° during the heating season and cooled to approximately 50° during the cooling season. Other functions may also be performed by central unit 12, such as humidification, dehumidification, and filtration. Primary air supply duct 92 is connected to each of primary air inlets 48 in units 16. Consequently, as fans 42 operate in units 16, primary air is supplied through duct 92 and induced into units 16 through inlets 48. Only enough primary air is supplied to meet building ventilation and dehumidification needs.

The chilled water required by both FCI units 16 and central unit 12 is provided by heat exchanger 107, winter cooler 109, water chiller 110, cooling tower 112, and chilled water piping 20 associated therewith. Pump 114 forces chilled water to FCI units 16 through chilled water supply line 20*a*. The chilled water temperature in line 20*a* remains fairly constant year-round, and, in a preferred embodiment, is approximately 55°. After passing through FCI units 16, the chilled water in return line 20*b* is somewhat warmer than that in supply line 20*a* and, in a preferred embodiment, is 65°.

All chilled water is provided by water chiller 110 during the cooling season and winter cooler (a heat exhanger) 109 in the heating season. Cooling tower 112 is connected through pipes 116 to both water chiller 110 and winter cooler 108 to provide heat dissipation for these units. Pump 118 forces fluid from tower 112 to cooler 109 and chiller 110. Valves 119 and 120 are included in pipes 116 so that only cooler 109 or chiller 110 is on line with cooling tower 112 at any given time. Typically, valves 119 are open in the heating season and closed in the cooling season, while valves 120 are open during the cooling season and closed during the heating season. Consequently, fluid flows from cooling tower 112 to only one of cooler 109 or chiller 110 at any given time.

Chilled water is supplied through supply pipe 122*a* through only one of winter cooler 109 or water chiller 110 at any given time. During the cooling season, the chilled water is supplied by chiller 110 and, accordingly, valves 126 are opened while valves 124 are closed. Conversely, during the heating season, chilled water is supplied by cooler 109, and valves 124 are open while valves 126 are closed. Valves 119 and 124 are preferably opened or closed at the same time, and likewise, valves 120 and 126 are preferably opened and closed at the same time. Pumps 128 and 130 pump chilled water from winter cooler 109 and water chiller 110, respectively.

Valves 132, 134, and 136 control the flow of chilled water through heat exchanger 107. Valves 132*s*, 134*s*, and 136*s* are open when the system is in its cooling configuration and closed when the system is in its heating configuration. Conversely, valves 132*w*, 134*w*, and 136*w* are open during the heating season and closed during the cooling season.

During the cooling season, water from chiller 110 passes through supply pipe 122*a* and valve 132*s* into heat exchanger 107. Glycol also circulates through heat exchanger 107, pump 139, and pipes 140 connected to coil 108. Consequently, the chilled water flowing through exchanger 107 chills the glycol conveyed to coil 108, which in turn cools the incoming outside air flowing through coil 108. The primary air is chilled to approximately 50° during the cooling season before being blown into supply duct 92. Chilled water leaving chiller 110 and entering exchanger 107 has a temperature of approximately 45° and, when leaving exchanger 107 through pump 141, a temperature of approximately 55°. The water leaving heat exchanger 107 then flows through valve 136*s* into line 144. Thermostat 142 on supply line 20*a* controls three-way valve 138 to blend the proper amount of chilled water from line 144 with return chilled water in line 20*b* to provide chilled water in supply line 20*a* having a temperature of 55°. In the preferred embodiment, because the chilled water leaving exchanger 107 is already 55°, no water is introduced from return line 20*b* at three-way valve 138. The return water in pipe 20*b* passes through valve 134*s* and line 122*b* back into chiller 110 to be rechilled.

During the heating season, chilled water in supply line 122*a* is produced by winter cooler 109 and has a temperature of approximately 55°. This chilled water passes through valves 132*w* and 138 to supply pipe 20*a* to the individual FCI units 16. The chilled water in return pipe 20*b* after passing through units 16 has a temperature of approximately 65° and flows through valve 134*w* into heat exchanger 107. The heat energy in the water flowing through heat exchanger 107 is transferred to the glycol also flowing through the heat exchanger. This warmed glycol then flows through line 140*a* to coil 108 within central unit 12. If the glycol temperature drops below 40°, thermostat 146 opens valve 148 anc circulates hot water through pipes 150*a* and 150*b* to booster heater 152 to prevent the glycol from becoming too cold. Consequently, the primary air passing through coil 108 is preheated to a temperature of approximately 40° before being blown into duct 92. The chilled water leaving exchanger 107 is approximately 55° and passes through valve 136*w* and return line 122*b* into winter cooler 109. Winter cooler 109 is actuated only as necessary to insure that the water leaving the cooler has a temperature of 55°, as required by FCI units 16.

FCI units 16 provide only sensible heating and cooling (i.e., without humidification and dehumidification). Because of the relatively high temperature of chilled water (55°) as compared with prior art systems and because the primary air supplied by unit 12 meets building dehumidification needs, drain pans 71 within the FCI units 16 do not have to be in turn connected to a drain. Drain pans 71 typically collect moisture from coils 46 only having extensive cool-down periods when chilled water is continuously supplied to cooling coil 46, which moisture later evaporates when the coils are not chilled continuously. The omission of drain connections results in savings both in installation and subsequent maintenance.

Because central unit 12 supplies only a fraction (10% in the preferred embodiment) of the primary air typically supplied with VAV systems, unit 12 can be significantly smaller than the central air handling unit in a VAV system, providing reduced initial construction costs as well as subsequent reduced operating costs. The primary air supplied by central unit 12 need only meet building ventilation and dehumidification needs. However, the system can be adapted to supply as much primary air as desired in a particular application.

Typically, a building will define a plurality of interior zone 38/exterior zone 36 pairs around the exterior periphery of the building. Each zone pair is provided with the structure shown in FIG. 2 so that the HVAC needs of that zone pair can be met, as described above.

In a preferred embodiment of the invention, central unit 12 and FCI units 16 operate only when the building is occupied. However, exterior units 16*e* cycle on and off during unoccupied hours in the heating season to maintain a 50° temperature in the exterior zones 36.

It should be understood that the above description is intended to be that of a preferred embodiment of the invention. Various changes and alterations might be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. A system for heating, cooling, and ventilating a structure having at least one exterior zone adjacent an exterior wall of said structure and at least one interior zone adjacent said exterior zone and opposite said exterior wall, said system comprising:

first means for moving air directly from said interior zone to said exterior zone, said first air moving means including first cooling means and first heating means for selectively cooling and heating, respectively, said air moving from said interior zone to said exterior zone; and second means for moving air directly from said exterior zone to said interior zone whereby air moving within said first air moving means does not admix with air moving within said second air moving means, said second air moving means including second cooling means for selectively cooling said air moving from said exterior zone to said interior zone.

2. A system as defined in claim 1 wherein said structure has a plurality of pairs of said exterior and interior zones on each structure floor; and wherein said system comprises a pair of said first and second air moving means for each of said zone pairs.

3. A system as defined in claim 2 wherein each of said first air moving means comprises:

a casing defining a recirculation air inlet and an air outlet;

fan means positioned within said casing for moving air through said casing from said recirculation air inlet to said air outlet;

primary air inlet means on said casing to be connected to a primary air source for making primary air available in said casing upstream of said fan means between said recirculation air inlet and said fan means, whereby when said primary air inlet means is connected to a primary air source and said fan means is actuated, recirculation air is drawn through said recirculation air inlet and primary air is induced into said casing, mixed with said recirculation air, and moved out of said casing with said recirculation air through said air outlet;

cooling means for cooling at least a portion of said air moving through said casing; and heating means for heating at least a second portion of said air moving through said casing.

4. A system as defined in claim 3 wherein each of said second air moving means comprises:

a casing defining a recirculation air inlet and an air outlet;

fan means positioned within said casing for moving air through said casing from said recirculation air inlet to said air outlet;

primary air inlet means on said casing to be connected to a primary air source for making primary air available in said casing upstream of said fan means between said recirculation air inlet and said fan means, whereby when said primary air inlet means is connected to a primary air source and said fan means is actuated, recirculation air is drawn through said recirculation air inlet and primary air is induced into said casing, mixed with said recirculation air, and moved out of said casing with said recirculation air through said air outlet; and cooling means for cooling at least a portion of said air moving through said casing.

5. A system as defined in claim 2 wherein each of said second air moving means comprises:

a casing defining a recirculation air inlet and an air outlet;

fan means positioned within said casing for moving air through said casing from said recirculation air inlet to said air outlet;

primary air inlet means on said casing to be connected to a primary air source for making primary air available in said casing upstream of said fan means between said recirculation air inlet and said fan means, whereby when said primary air inlet means is connected to a primary air source and said fan means is actuated, recirculation air is drawn through said recirculation air inlet and primary air is induced into said casing, mixed with said recirculation air, and moved out of said casing with said recirculation air through said air outlet; and cooling means for cooling at least a portion of said air moving through said casing.

6. A system as defined in claim 1 further comprising primary air supply means operatively connected to at least one of said first and second air moving means for introducing primary air into said structure.

7. A system for heating, cooling, and ventilating a structure having a plurality of zone pairs each including an exterior zone adjacent an exterior wall of said structure and an interior zone adjacent said exterior zone and opposite said exterior wall and further for preheating primary air, said system comprising for each of said zone pairs:

first means for moving air directly from said interior zone to said exterior zone, said first air moving means including first cooling means and first heating means for selectively cooling and heating, respectively, said air moving from said interior zone to said exterior zone; and second means for moving air directly from said exterior zone to said interior zone whereby air moving within said first air moving means does not admix with air moving within said second air moving means, said second air moving means including second cooling means for selectively cooling said air moving from said exterior zone to said interior zone, selected ones of said first and second cooling means including first coil means positioned in said moving air for conveying a liquid and a first liquid conveyed in said first coil means, said first liquid having a lower temperature than said moving air, whereby said first liquid is warmed as said moving air passes through said first coil means;

said system further comprising:

primary air supply means operatively connected to at least one of said first and second air moving means for introducing primary air into said structure;

second coil means positioned within said primary air supply means for conveying a liquid;

a second liquid conveyed in said second coil means, said second liquid having a higher temperature than said primary air, whereby said second liquid is cooled as said primary air is preheated as said primary air passes through said second coil means; and heat exchanger means for transferring the heat energy of said first liquid to said second liquid.

8. A system for heating and ventilating a structure having at least one exterior zone adjacent an exterior wall of said structure and at least one interior zone adjacent said exterior zone and opposite said exterior wall, said system comprising:

first means for moving air directly from said interior zone to said exterior zone, said first air moving means including first heating means for selectively heating said air moving from said interior zone to said exterior zone; and second means for moving air directly from said exterior zone to said interior zone whereby air within said first air moving means does not admix with air within said second air moving means, said second air moving means including second cooling means for selectively cooling said air moving from said exterior zone to said interior zone.

9. A system as defined in claim 8 wherein said structure has a plurality of pairs of said exterior and interior zones on each structure floor; and wherein said system comprises a pair of said first and second air moving means for each of said zone pairs.

10. A system as defined in claim 9 wherein each of said first air moving means comprises:

a casing defining a recirculation air inlet and an air outlet;

fan means positioned within said casing for moving air through said casing from said recirculation air inlet to said air outlet;

primary air inlet means on said casing to be connected to a primary air source for making primary air available in said casing upstream of said fan means between said recirculation air inlet and said fan means, whereby when said primary air inlet means is connected to a primary air source and said fan means is actuated, recirculation air is drawn through said recirculation air inlet and primary air is induced into said casing, mixed with said recirculation air, and moved out of said casing with said recirculation air through said air outlet; and heating means for heating at least a portion of said air moving through said casing.

11. A system as defined in claim 10 wherein each of said second air moving means comprises:

a casing defining a recirculation air inlet and an air outlet;

fan means positioned within said casing from moving air through said casing from said recirculation air inlet to said air outlet;

primary air inlet means on said casing to be connected to a primary air source for making primary air available in said casing upstream of said fan means between said recirculation air inlet and said fan means, whereby when said primary air inlet means is connected to a primary air source and said fan means is actuated, recirculation air is drawn through said recirculation air inlet and primary air is induced into said casing, mixed with said recirculation air, and moved out of said casing with said recirculation air through said air outlet; and cooling means for cooling at least a portion of said air moving through said casing.

12. A system as defined in claim 9 wherein each of said second air moving means comprises:

a casing defining a recirculation air inlet and an air outlet;

fan means positioned within said casing for moving air through said casing from said recirculation air inlet to said air outlet;

primary air inlet means on said casing to be connected to a primary air source for making primary air available in said casing upstream of said fan means between said recirculation air inlet and said fan means, whereby when said primary air inlet means in connected to a primary air source and said fan means is actuated, recirculation air is drawn through said recirculation air inlet and primary air is induced into said casing, mixed with said recirculation air, and moved out of said casing with said recirculation air through said air outlet; and cooling means for cooling at least a portion of said air moving through said casing.

13. A system as defined in claim 8 further comprising primary air supply means operatively connected to at least one of said first and second air moving means for introducing primary air into said structure.

14. A system for heating and ventilating a structure having a plurality of zone pairs each including an exterior zone adjacent an exterior wall of said structure and an interior zone adjacent said exterior zone and opposite said exterior wall and further for preheating primary air, said system comprising for each of said zone pairs:

first means for moving air directly from said interior zone to said exterior zone, said first air moving means including first heating means for selectively heating said air moving from said interior zone to said exterior zone; and second means for moving air directly from said exterior zone to said interior zone whereby air within said first air moving means does not admix with air within said second air moving means, said second air moving means including second cooling means for selectively cooling said air moving from said exterior zone to said interior zone, said second cooling means including first coil means positioned in said moving air for conveying a liquid and a first liquid conveyed in said first coil means, said first liquid having a lower temperature than said moving air, whereby said first liquid is warmed as said moving air passes through said first coil means;

said system further comprising:

primary air supply means operatively connected to at least one of said first and second air moving means for introducing primary air into said structure;

second coil means positioned within said primary air supply means for conveying a liquid;

a second liquid conveyed in said second coil means, said second liquid having a higher temperature than said primary air, whereby said second liquid is cooled as said primary air is preheated as said primary air passes through said second coil means; and heat exchanger means for transferring the heat energy of said first liquid to said second liquid.

15. A system for cooling and ventilating a structure having at least one exterior zone adjacent an exterior wall of said structure and at least one interior zone adjacent said exterior zone and opposite said exterior wall, said system comprising:

first means for moving air directly from said interior zone to said exterior zone, said first air moving means including first cooling means for selectively cooling said air moving from said interior zone to said exterior zone; and second means for moving air directly from said exterior zone to said interior zone whereby air within said first air moving means does not admix with air within said second air moving means, said second air moving means including second cooling means for selectively cooling said air moving from said exterior zone to said interior zone.

16. A system as defined in claim 15 wherein said structure has a plurality of pairs of said exterior and interior zones on each structure floor; and wherein said system comprises a pair of said first and second air moving means for each of said zone pairs.

17. A system as defined in claim 16 wherein each of said first air moving means comprises:

a casing defining a recirculation air inlet and an air outlet;

fan means positioned within said casing for moving air through said casing from said recirculation air inlet to said air outlet;

primary air inlet means on said casing to be connected to a primary air source for making primary air available in said casing upstream of said fan means between said recirculation air inlet and said fan means, whereby when said primary air inlet means is connected to a primary air source and said fan means is actuated, recirculation air is drawn through said recirculation air inlet and primary air is induced into said casing, mixed with said recirculation air, and moved out of said casing with said recirculation air through said air outlet; and cooling means for cooling at least a portion of said air moving through said casing.

18. A system as defined in claim 17 wherein each of said second air moving means comprises:

a casing defining a recirculation air inlet and an air outlet;

fan means positioned within said casing for moving air through said casing from said recirculation air inlet to said air outlet;

primary air inlet means on said casing to be connected to a primary air source for making primary air available in said casing upstream of said fan means between said recirculation air inlet and said fan means, whereby when said primary air inlet means is connected to a primary air source and said fan means is actuated, recirculation air is drawn through said recirculation air inlet and primary air is induced into said casing, mixed with said recirculation air, and moved out of said casing with said recirculation air through said air outlet; and cooling means for cooling at least a portion of said air moving through said casing.

19. A system as defined in claim 16 wherein each of said second air moving means comprises:

a casing defining a recirculation air inlet and an air outlet;

fan means positioned within said casing for moving air through said casing from said recirculation air inlet to said air outlet;

primary air inlet means on said casing to be connected to a primary air source for making primary air available in said casing upstream of said fan means between said recirculation air inlet and said fan means, whereby when said primary air inlet means is connected to a primary air source and said fan means is actuated, recirculation air is drawn through said recirculation air inlet and primary air is induced into said casing, mixed with said recirculation air, and moved out of said casing with said recirculation air through said air outlet; and cooling means for cooling at least a portion of said air moving through said casing.

20. A system as defined in claim 15 further comprising primary air supply means operatively connected to at least one of said first and second air moving means for introducing primary air into said structure.

21. A method of heating, cooling, and/or ventilating a structure having at least one exterior zone adjacent an exterior wall and at least one interior zone adjacent said exterior zone and opposite said exterior wall, said method comprising the steps of:

moving air directly from said interior zone to said exterior zone;

at least one of selectively cooling and selectively healing said air moving from said interior zone to said exterior zone;

moving air directly from said exterior zone to said interior zone, whereby air moving from said interior zone to said exterior zone and air moving from said exterior zone to said interior zone do not admix;

selectively cooling said air moving from said exterior zone to said interior zone.

22. A method as defined in claim 21 further comprising the steps of:

supplying primary air; and mixing said primary air with at least one of said air moving from said interior zone to said exterior zone or said air moving from said exterior zone to said interior zone to introduce primary air into said structure.

23. A method as defined in claim 22 further for preheating said primary air wherein at least one of said cooling steps comprises the steps of:

positioning a first coil means in said moving air for conveying liquid; and conveying a first liquid through said first coil means, said first liquid being cooler than said moving air, whereby said first liquid is warmed as said moving air moves past said first coil means; said method further comprising the steps of:

positioning a second coil means in said primary air for conveying liquid;

conveying a second liquid through said second coil means, said second liquid being warmer than said primary air, whereby said second liquid is cooled as said primary air moves past said second coil means to be preheated; and conveying both said first and second liquids through heat exchanger means, whereby the heat energy of said first liquid is transferred to said second liquid.

* * * * *

UNITED STATES PATENT AND TRADEMARK OFFICE

CERTIFICATE OF CORRECTION

PATENT NO. : 4,473,107

DATED : September 25, 1984

INVENTOR(S) : Larry E. Fairbrother et al

It is certified that error appears in the above—identified patent and that said Letters Patent is hereby corrected as shown below:

Column 4, line 41:
"required" should be --require--;

Column 6, line 66:
"if" should be --it--;

Column 9, line 45:
"having" should be --during--; and

Column 15, line 25:
"healing" should be --heating--.

Signed and Sealed this

*Fourteenth* Day of *May 1985*

[SEAL]

*Attest:*

DONALD J. QUIGG

*Attesting Officer* *Acting Commissioner of Patents and Trademarks*